US007354111B1

(12) United States Patent
Hsieh

(10) Patent No.: US 7,354,111 B1
(45) Date of Patent: Apr. 8, 2008

(54) SECURING ASSEMBLY FOR A DRUMMER'S CHAIR

(75) Inventor: Wu-Hong Hsieh, Taipei Hsien (TW)

(73) Assignee: K.H.S. Musical Instrument Co., Ltd., Taipei Hsien (TW)

( * ) Notice: Subject to any disclaimer, the term of this patent is extended or adjusted under 35 U.S.C. 154(b) by 0 days.

(21) Appl. No.: 11/604,468

(22) Filed: Nov. 27, 2006

(51) Int. Cl.
*A47C 9/00* (2006.01)

(52) U.S. Cl. ..... 297/461; 297/195.1; 297/195.11; 297/344.12

(58) Field of Classification Search ..... 297/461, 297/344.12, 195.1, 195.11
See application file for complete search history.

(56) References Cited

U.S. PATENT DOCUMENTS 3,230,909 A * 1/1966 Watson ..... 108/150
3,770,319 A * 11/1973 Ono ..... 297/461
3,870,271 A * 3/1975 Bowman ..... 248/406.2
3,991,965 A * 11/1976 Westover et al. ..... 248/406.2
5,738,326 A * 4/1998 Liao ..... 248/405
6,672,660 B2 * 1/2004 Hoshino ..... 297/195.1
6,695,407 B1 * 2/2004 Lin ..... 297/423.38

* cited by examiner

*Primary Examiner*—David Dunn
*Assistant Examiner*—Erika Garrett
(74) *Attorney, Agent, or Firm*—Alan Kamrath; Kamrath & Associates PA

(57) ABSTRACT

A securing assembly for a drummer seat having a cylinder integrally formed on a bottom face of the base and having a cutout in a peripheral edge thereof and a securing ring connected to the cylinder and having a boss to be received in the cutout. The cutout has two opposed inclined side faces and a flat bottom face sandwiched between the two inclined side faces. The boss has two inclined sides corresponding to the two inclined side faces of the cutout and a connection face sandwiched between the two inclined sides and corresponding to the bottom face such that engagement between the inclined side faces of the cutout and the inclined sides of the boss and between the bottom face and the connection face allow the boss to be immovably received inside the cutout.

2 Claims, 6 Drawing Sheets

SECURING ASSEMBLY FOR A DRUMMER'S CHAIR

BACKGROUND OF THE INVENTION

1. Field of the Invention

The present invention relates to a securing assembly, and more particularly to a securing assembly for a drummer's chair to provide a stable support to the drummer despite the drummer's performance.

2. Description of the Prior Art

A drummer needs a stable chair so that the drummer is able to do whatever he is supposed to do on stage. If the chair is not able to provide a stable support to the drummer, the drummer will be distracted by the rocking of the chair while performing on the stage. Therefore, a stable chair does make a difference to the drummer's performance.

With reference to FIG. 5, a conventional securing assembly includes a base (5) and a securing ring (6). The base (5) is securely attached to a bottom side of a chair cushion (not shown) and the securing ring (6) is provided to secure a supporting pole (not shown) extending upright from a foot assembly (not shown) of a chair and into the base (5).

The base (5) has a hollow cylinder (51) formed on a bottom face of the base (5) and having a central hole (50) and a cutout (52) defined in a peripheral edge forming the cylinder (51) to communicate with the central hole (50). The cutout (52) is substantially rectangular in cross section.

The securing ring (6) is operated like a C clip so that it has a centrally defined passage allowing an extension of the supporting pole, a gap (61) defined to communicate with the passage and a boss (62) formed on a peripheral edge of the securing ring (6).

With reference to FIG. 6, it is noted that after a distal end of the supporting pole (7) extends through the passage of the securing ring (6), the distal end of the supporting pole (7) is mounted in the central hole (50) of the cylinder (51). In order to secure the supporting pole (7) in the base (5), the boss (62) of the securing ring (6) is received in the cutout (52). Then a fixing bolt (not shown) is employed to tighten the engagement between the securing ring (6) and the supporting pole (7). Thus, the boss (62) is securely received inside the cutout (52).

Yet, in order to allow the boss (62) to be received in the cutout (52), the size of the cutout (52) has to be larger than that of the boss (62) such that an operator is able to smoothly place the boss (62) into the cutout (52). As a result of the size difference between the cutout (52) and the boss (62), the boss (62) is not rigidly received inside the cutout (52), but movably received inside the cutout (52). That is, when the drummer sitting on top of the chair is performing, the rocking of the chair due to the loose engagement between the cutout (52) and the boss (62) distracts the drummer. Because the drummer has to do his or her best to maintain balance while performing, the drummer's performance will not be as good as expected.

To overcome the shortcomings, the present invention provides an improved securing assembly to mitigate the aforementioned problems.

SUMMARY OF THE INVENTION

The primary objective of the present invention is to provide an improved securing assembly to provide a stable supporting force to allow the drummer to perform well.

The securing assembly for a drummer's chair of the present invention includes a cylinder and a securing ring.

The cylinder has an axis and a cutout defined in a peripheral edge of the cylinder, with two opposed side faces defining the cutout being inclined relative to each other. A bottom face is formed between the two inclined side faces. The securing ring has a top side, a bottom side, a circular shaped wall, an inner circumference, and an adjustable clasp. The adjustable clasp extends radially from the circular shaped wall and has a gap to tighten the securing ring around the supporting pole. The securing ring has a boss formed on a peripheral edge of the securing ring to correspond to and be received in the cutout of the cylinder. The boss axially extends from the top side of the securing ring and is located at a non-diametrically opposed location from the adjustable clasp. The boss has two opposed sides being inclined relative to each other and a flat connection face formed between the two opposed sides of the boss to engage with the bottom face of the cylinder. Thus, due to the inclined side faces of the cutout and the inclined sides of the boss and after the boss is received inside the cutout, engagement between the securing ring and the cylinder is firmly secured. There is no relative movement between the cylinder and the securing ring enabling the drummer to perform well without any distraction from the chair.

Other objects, advantages and novel features of the invention will become more apparent from the following detailed description when taken in conjunction with the accompanying drawings.

DETAILED DESCRIPTION OF THE PREFERRED EMBODIMENT

Figure 1:
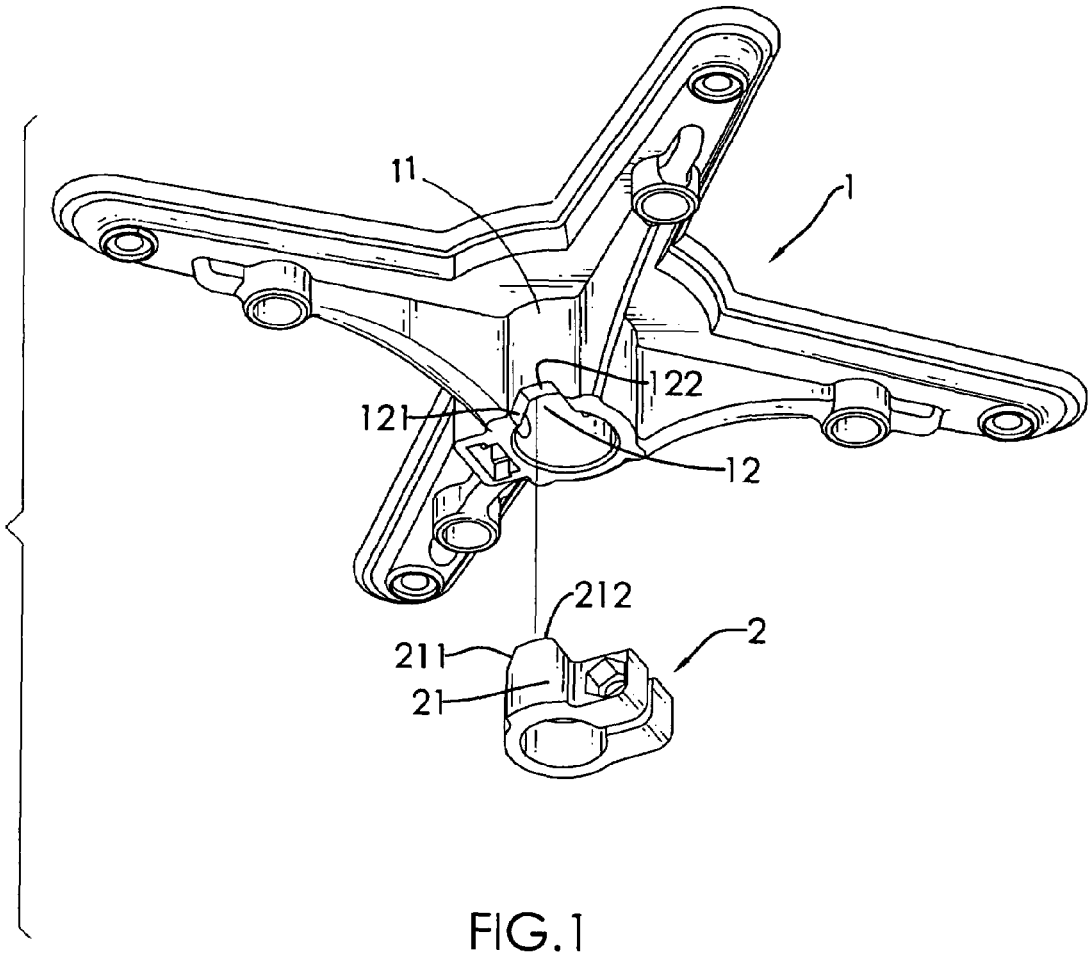
FIG. 1 is an exploded perspective view of the securing assembly of the present invention.
Figure 2:
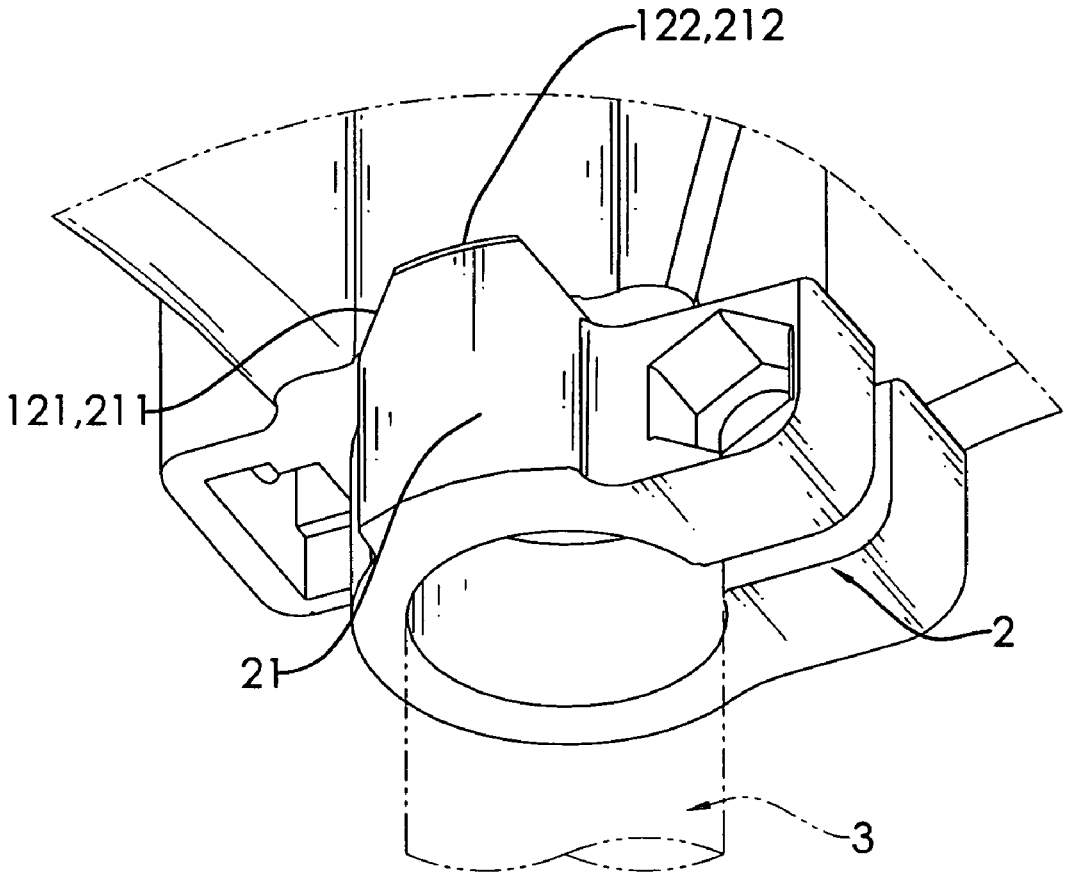
FIG. 2 is an enlarged perspective view showing that the securing ring is connected to the cylinder.

With reference to FIGS. 1 and 2, it is noted that a base (1) is provided to securely attach to a bottom face of a chair cushion, and a securing ring (2) is provided to secure a supporting pole (3) extending upright from a foot assembly of the chair. How the base (1) is attached to the bottom face of the chair cushion and how the supporting pole (3) is secured by the securing ring (2) are all well known in the art such that the following description will be focused on the improvement of the present invention.

The securing assembly in accordance with the present invention includes a cylinder (11) formed on a bottom face of the base (1). The cylinder (11) has an axis and a centrally defined passage to allow an extension of the distal free end of the supporting pole (3) and a cutout (12) defined in a peripheral edge of the cylinder (11).

The cutout (12) has two opposed inclined side faces (121) relative to each other and a bottom face (122) sandwiched between the two inclined side faces (121).

The securing ring (2) has a top side, a bottom side, a circular shaped wall extending between the top side and the bottom side, an inner circumference, and an adjustable clasp. The adjustable clasp has a gap to tighten the securing ring (2) around the supporting pole (3). The gap extends between the top side and the bottom side into the circular shaped wall and intersects the inner circumference. A boss (21) formed on the a peripheral edge of the securing ring (2) extends axially from the top side of the securing ring (2). The boss (21) has two opposed inclined sides (211) corresponding to the two inclined side faces (121) and a connection face (212) corresponding to the bottom face (122). The boss (21) is located at a non-diametrically opposed location from the adjustable clasp.

Figure 3:
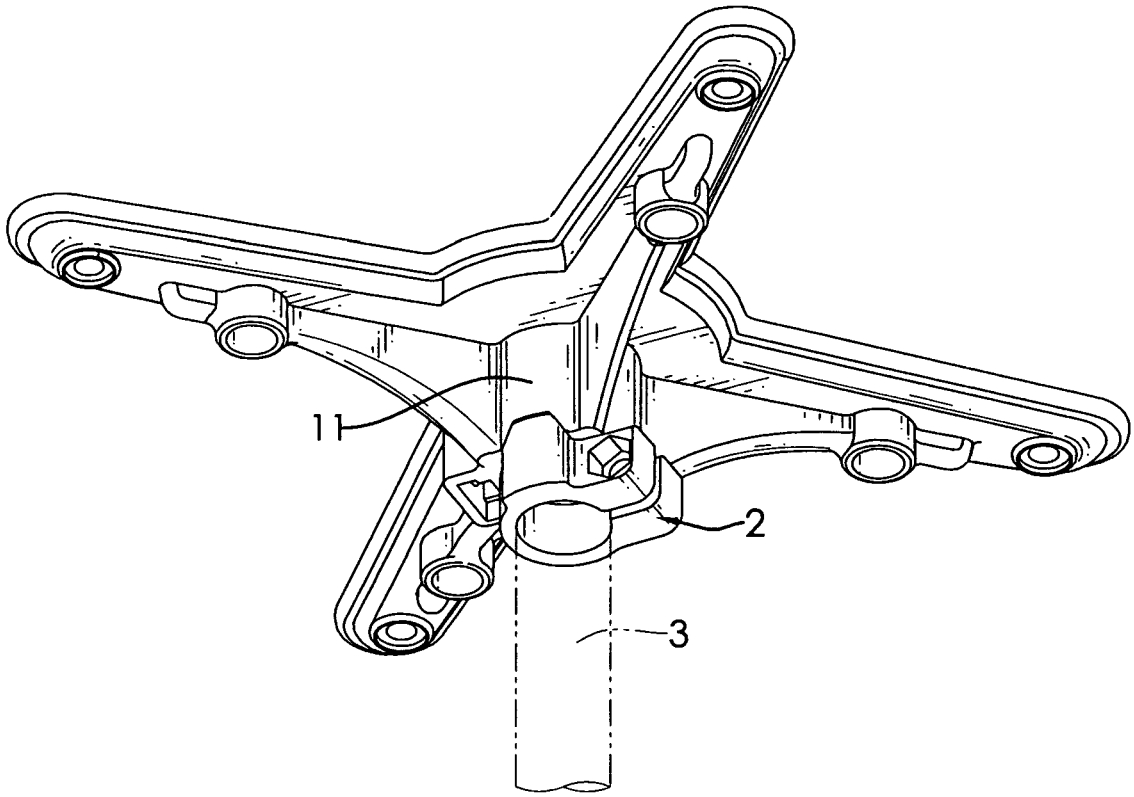
FIG. 3 is a perspective view showing that the supporting pole is inserted into the securing ring and the securing ring is securely connected to the cylinder.

With reference to FIG. 3, after the supporting pole (3) is extended through the securing ring (2) and into the cylinder (11), the boss (21) is received in the cutout (12) to have the two inclined sides (211) engaged with the two inclined side faces (121) and the connection face (212) is engaged with the bottom face (122) and secures the engagement between the cylinder (11) and the securing ring (2). The inclined side faces (121) of the cutout (12) and the inclined sides (211) of the boss (21) allow the boss (21) to enter the cutout (12) deeper, and the engagement between the securing ring (2) and the cylinder (11) becomes tighter.

Figure 4:
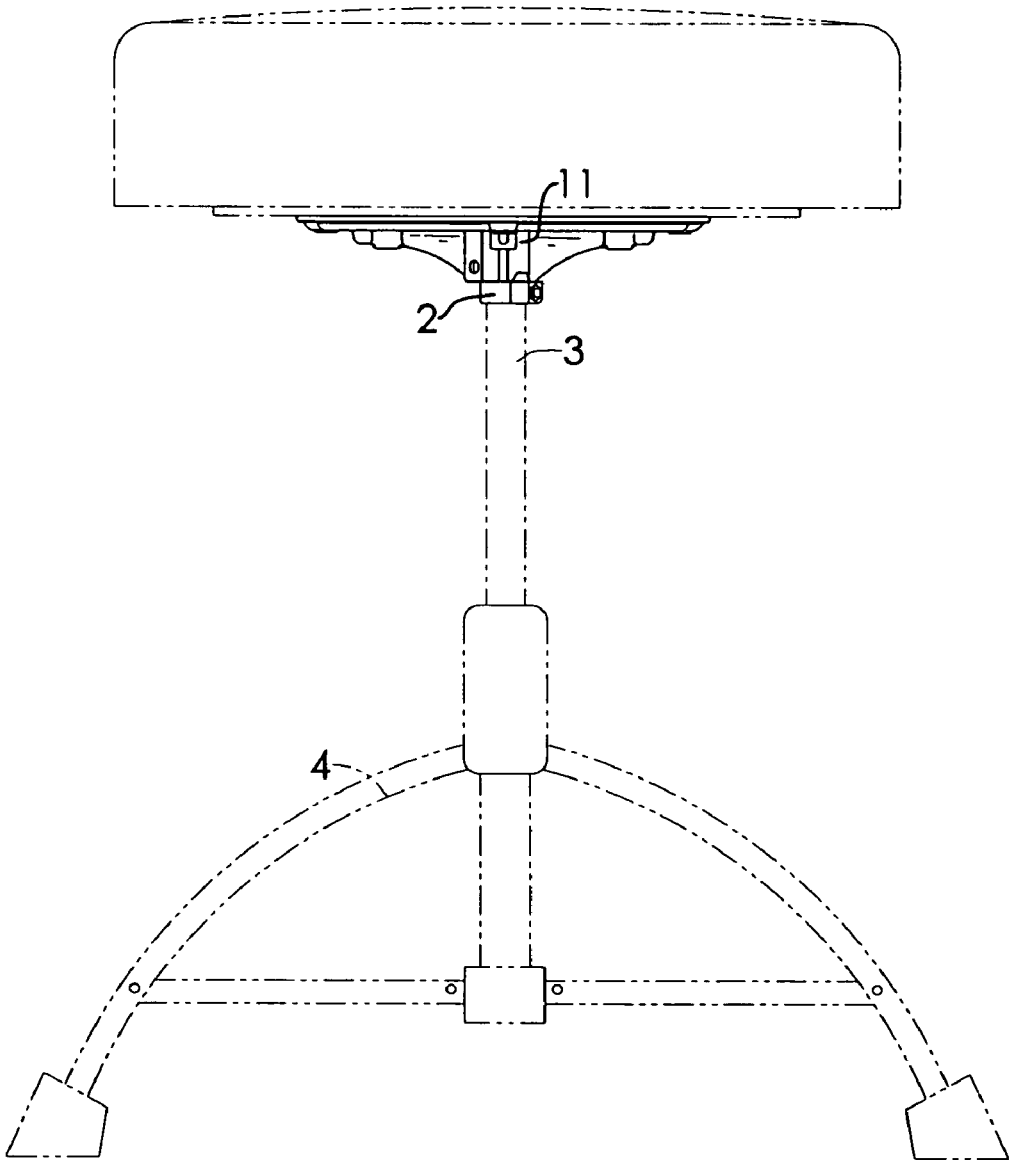
FIG. 4 is a side plan view showing the securing assembly of the present invention stabilize the chair.
Figure 5:
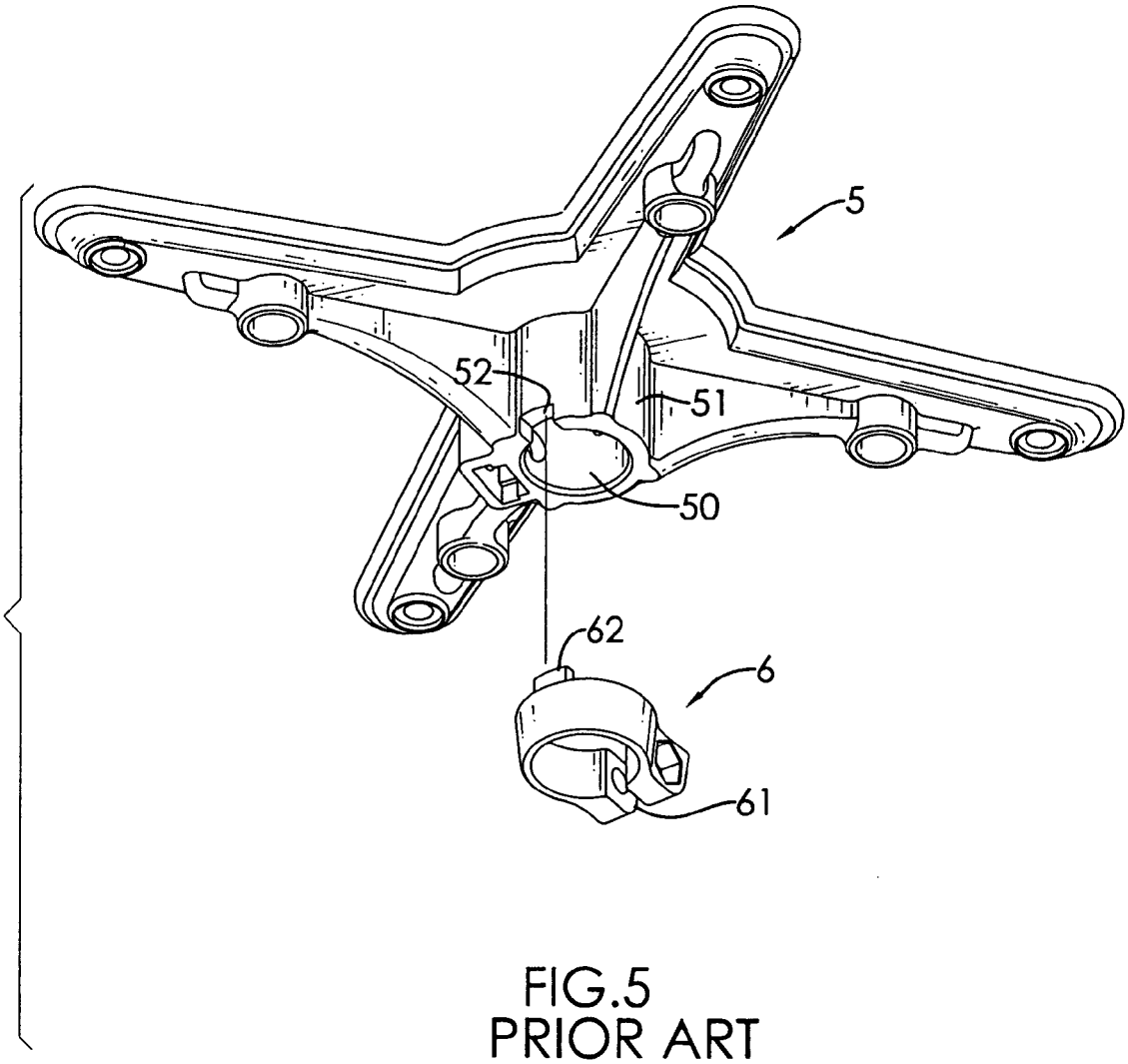
FIG.5 PRIOR ART
FIG. 5 is an exploded perspective view of a conventional securing assembly for a chair.
Figure 6:
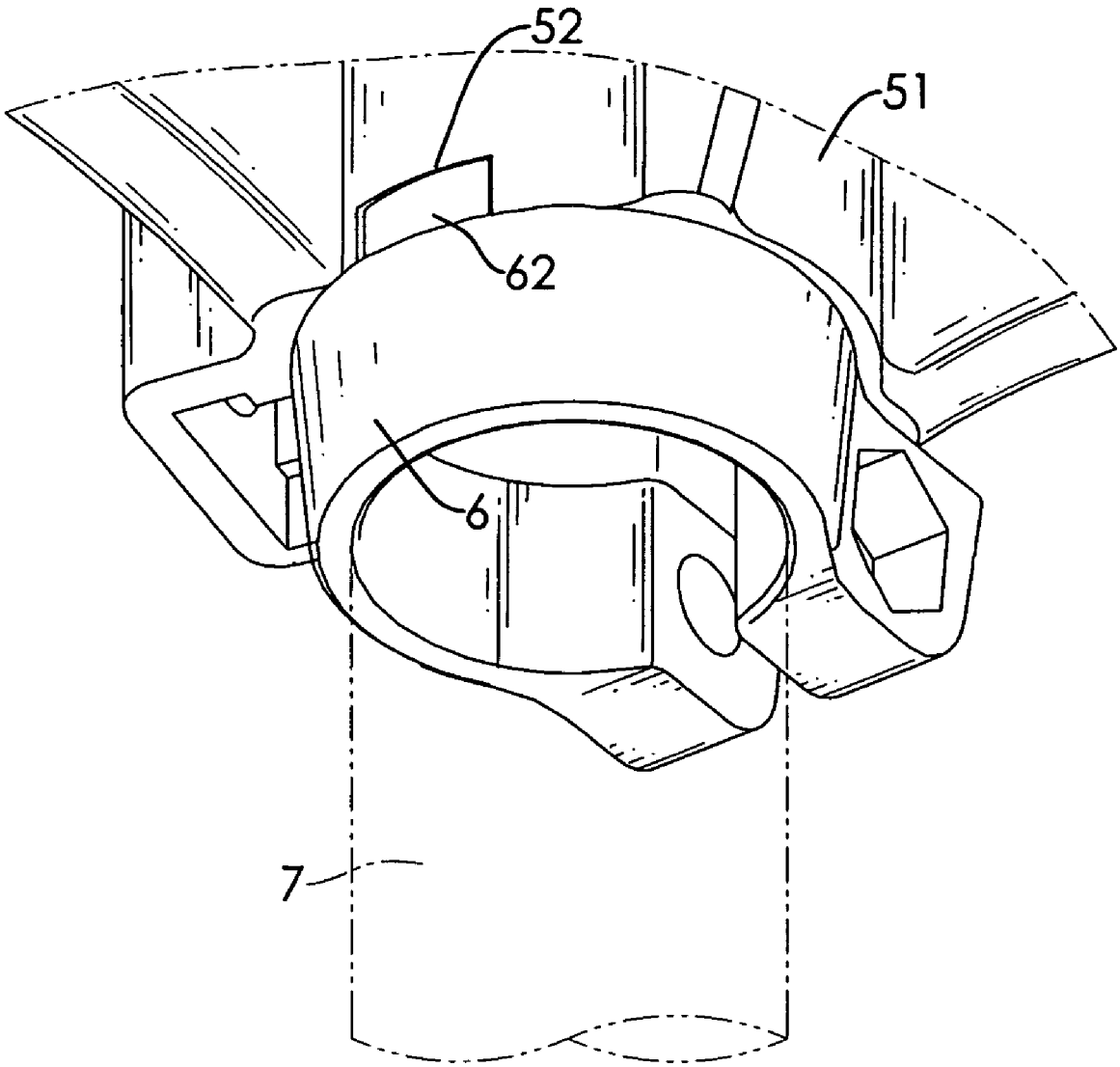
FIG.6 PRIOR ART
FIG. 6 is an enlarged perspective view showing the engagement between the conventional securing ring and the cylinder of FIG. 5.

With reference to FIGS. 3 and 4, after the securing ring (2) and the cylinder (11) are securely connected together and the boss (21) is rigidly received inside the cutout (12), the chair is immovable. The supporting pole (3) extending from the foot assembly (4) is firmly secured by the securing ring (2) so that the securing assembly of the present invention is firmly constructed, and, thus, the chair is able to provide a stable supporting force to the drummer sitting on top of the chair.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A securing assembly for a drummer's chair having a base attached to a bottom face of a chair cushion;

a cylinder integrally formed on a bottom face of the base, wherein the cylinder has an axis, with the cylinder adapted to receive a supporting pole;

a cutout defined in a peripheral edge of the cylinder;

a securing ring having a top side, a bottom side, a circular shaped wall extending between the top side and the bottom side, an inner circumference defining the circular shaped wall and an adjustable clasp extending radially from the circular shaped wall, with the adjustable clasp having a gap to tighten the securing ring around the supporting pole, with the gap extending between the top side and the bottom side into the circular shaped wall and intersecting the inner circumference, with the securing ring securely connected to the cylinder to firmly clasp the supporting pole;

a boss formed in a peripheral edge on the top side of the securing ring, with the boss extending axially above the top side, with the boss located at a non-diametrically opposed location to the adjustable clasp along the circular shaped wall, wherein the cutout has two opposed inclined side faces and a flat bottom face sandwiched between the two opposed inclined side faces, with the flat bottom face having a first end and a second end, with the first end opposite and spaced from the second end, with one of the two opposed inclined side faces extending obliquely from the first end, with another one of the two opposed inclined side faces extending obliquely from the second end; and wherein the boss has two inclined sides corresponding to the two opposed inclined side faces of the cutout and a connection face sandwiched between the two inclined sides and corresponding to the flat bottom face, with the two opposed inclined side faces of the cutout engaging the two inclined sides of the boss, with the flat bottom face engaging the connection face, with the boss immovably received inside the cutout, wherein the flat bottom face abuts and is parallel to the connection face when the boss is received inside the cutout.

2. The securing assembly of claim 1, wherein the securing ring further comprises an outer perimeter, with the inner circumference being smaller than the outer perimeter, with a first width defined between the inner circumference and the outer perimeter, with a second width defined between the inner circumference and the outer perimeter at the non-diametrically opposed location of the boss, with the first width being smaller than the second width, with the second width integrally formed as a single monolithic piece with the circular shaped wall and the boss.

* * * * *